US006028674A

United States Patent [19]

Tognazzini

[11] Patent Number: 6,028,674

[45] Date of Patent: Feb. 22, 2000

[54] CONSUMER-DOCUMENT INKING MONITOR AND CONTROL

[75] Inventor: Bruce Tognazzini, Woodside, Calif.

[73] Assignee: Sun Microsystems, Inc., Palo Alto, Calif.

[21] Appl. No.: 08/652,047

[22] Filed: May 23, 1996

[51] Int. Cl.[7] ..... B41F 5/06

[52] U.S. Cl. ..... 358/1.13; 358/1.13; 358/1.14; 358/1.01; 399/49; 400/120.11; 356/425

[58] Field of Search ..... 395/113, 114, 395/101; 399/49; 400/120.11; 356/425

[56] References Cited

U.S. PATENT DOCUMENTS 3,756,725 9/1973 Manring ..... 356/195
3,934,121 1/1976 Kratt et al. ..... 235/61.6
4,003,660 1/1977 Christie, Jr. et al. ..... 356/178
4,955,290 9/1990 Kipphan et al. ..... 101/183

*Primary Examiner*—Mark R. Powell
*Assistant Examiner*—Lance W. Sealey
*Attorney, Agent, or Firm*—McDermott, Will & Emery

[57] ABSTRACT

In a printer, periodic testing of printer ink density occurs once the number of print operations exceeds a particular threshold. The threshold is either determined from use or from statistics which summarize the performance of a particular manufacturer and ink supply. Testing results are reported to a maintenance facility and to an MIS application over a network or over a point to point link. Local warnings may be given that the ink supply is low and double printing may be used to darken the printed product until the ink supply is changed.

20 Claims, 8 Drawing Sheets

CONSUMER-DOCUMENT INKING MONITOR AND CONTROL

BACKGROUND OF THE INVENTION

1. Field of the Invention

The invention relates to printers and more particularly to computer driven printers which require replacement of a source of ink.

2. Description of Related Art

Computer driven printing systems are known in the art. A computer user or program executes a print command which results in activation of a printer, typically through a print driver, which then prints the requested information on a medium, such as paper. Typically, when the printer supply of ink is running low, the print quality deteriorates. At some point, the quality of the print job becomes unacceptable and a user will then change the printer's ink supply and reprint the last job.

The Problems

Today, it is an exception, rather than a rule, for a consumer to receive a machine-printed receipt or other document that is legible. This creates problems for people attempting to return merchandise, submit expense reports, or to drive safely to a destination at night while trying to read rental car instructions sheets that are all but invisible.

A fundamental maxim of quality management is that if you can't measure it, you can't manage it. Companies that otherwise maintain high standards of quality are doing little or nothing to address the problem of ink density. This lack of response is directly traceable to an absence of feedback. People tend not to complain, and no objective measurement and reporting system is available.

SUMMARY OF THE INVENTION

The invention consists of apparatus, systems, methods and computer program products for measuring, reporting, controlling and managing ink density. Measurement is accomplished by printing a reference area, such as a solid block of a certain size, such as one having the size of a single character's dimensions, and then detecting the amount of light either reflected from or transmitted through the paper on which the reference block is printed. When the intensity of light either reflected or transmitted increases, then it is apparent that the ink density on the reference block is becoming lighter. At some point, a decision threshold is reached which triggers a reporting action which results in appropriate personnel being notified that a change in ink supply is required. Low ink warnings and notifications occur in a number of ways in accordance with the invention.

The invention is directed to printing apparatus including a computer processor, a printer connected to the computer processor, and an ink density detector connected to the computer and activated thereby to sample density of ink deposited on a print medium during a printing operation. The ink density detector comprises a light source, a photodetector and an optional collimator. When ink density is unsatisfactory, the apparatus takes one or more corrective actions. The printing apparatus further includes a transmitter or a modem for notifying remotely located personnel and/or a remotely located process when ink density is unsatisfactory. When ink density is unsatisfactory each character is double or triple printed, a warning indicator is activated and the ink supply optionally changed.

The invention is also directed to a method of monitoring the quality of the product produced during printing by sampling density of ink deposited on a print medium during a printing operation. The sampling begins when a number of print operations equals or exceeds a predictive threshold. When the density of ink is unsatisfactory, the same corrective actions are taken.

The invention is also directed to a method of monitoring the quality of the product produced during printing by determining a predictive threshold of print operations expected to be obtained from an ink supply, incrementing a counter for each print operation, and sampling density of ink deposited on a print medium during a printing operation, beginning when the count of the counter equals or exceeds the predictive threshold.

The invention is also directed to a system for maintaining the quality of printing operations including a network, one or more computers connected to the network, and a printer connected to the network and capable of sampling density of ink deposited on a print medium during a printing operation. The printer is configured to notify maintenance personnel or a management information system process over the network when the density of ink is unsatisfactory. The printer may alternatively be configured to notify maintenance personnel or a management information system process over a cellular telephone link when the density of ink is unsatisfactory. The printer is alternatively configured to receive a remote query over the network and report when the density of ink is unsatisfactory.

The invention is also directed to a computer program product, including a memory medium, and a computer program stored on the medium, the computer program containing instructions to cause a printer to sample the density of ink produced by a printer during printing operations.

Still other objects and advantages of the present invention will become readily apparent to those skilled in the art from the following detailed description, wherein only the preferred embodiment of the invention is shown and described, simply by way of illustration of the best mode contemplated of carrying out the invention. As will be realized, the invention is capable of other and different embodiments, and its several details are capable of modifications in various obvious respects, all without departing from the invention. Accordingly, the drawing and description are to be regarded as illustrative in nature, and not as restrictive.

BRIEF DESCRIPTION OF DRAWINGS

The objects, features and advantages of the system of the present invention will be apparent from the following description in which.

NOTATIONS AND NOMENCLATURE

The detailed descriptions which follow may be presented in terms of program procedures executed on a computer or network of computers. These procedural descriptions and representations are the means used by those skilled in the art to most effectively convey the substance of their work to others skilled in the art.

A procedure is here, and generally, conceived to be a self-consistent sequence of steps leading to a desired result. These steps are those requiring physical manipulations of physical quantities. Usually, though not necessarily, these quantities take the form of electrical or magnetic signals capable of being stored, transferred, combined, compared, and otherwise manipulated. It proves convenient at times, principally for reasons of common usage, to refer to these signals as bits, values, elements, symbols, characters, terms, numbers, or the like. It should be noted, however, that all of these and similar terms are to be associated with the appropriate physical quantities and are merely convenient labels applied to these quantities.

Further, the manipulations performed are often referred to in terms, such as adding or comparing, which are commonly associated with mental operations performed by a human operator. No such capability of a human operator is necessary, or desirable in most cases, in any of the operations described herein which form part of the present invention; the operations are machine operations. Useful machines for performing the operation of the present invention include general purpose digital computers or similar devices.

The present invention also relates to apparatus for performing these operations. This apparatus may be specially constructed for the required purpose or it may comprise a general purpose computer as selectively activated or reconfigured by a computer program stored in the computer. The procedures presented herein are not inherently related to a particular computer or other apparatus. Various general purpose machines may be used with programs written in accordance with the teachings herein, or it may prove more convenient to construct more specialized apparatus to perform the required method steps. The required structure for a variety of these machines will appear from the description given.

DESCRIPTION OF THE PREFERRED EMBODIMENT

Figure 1:
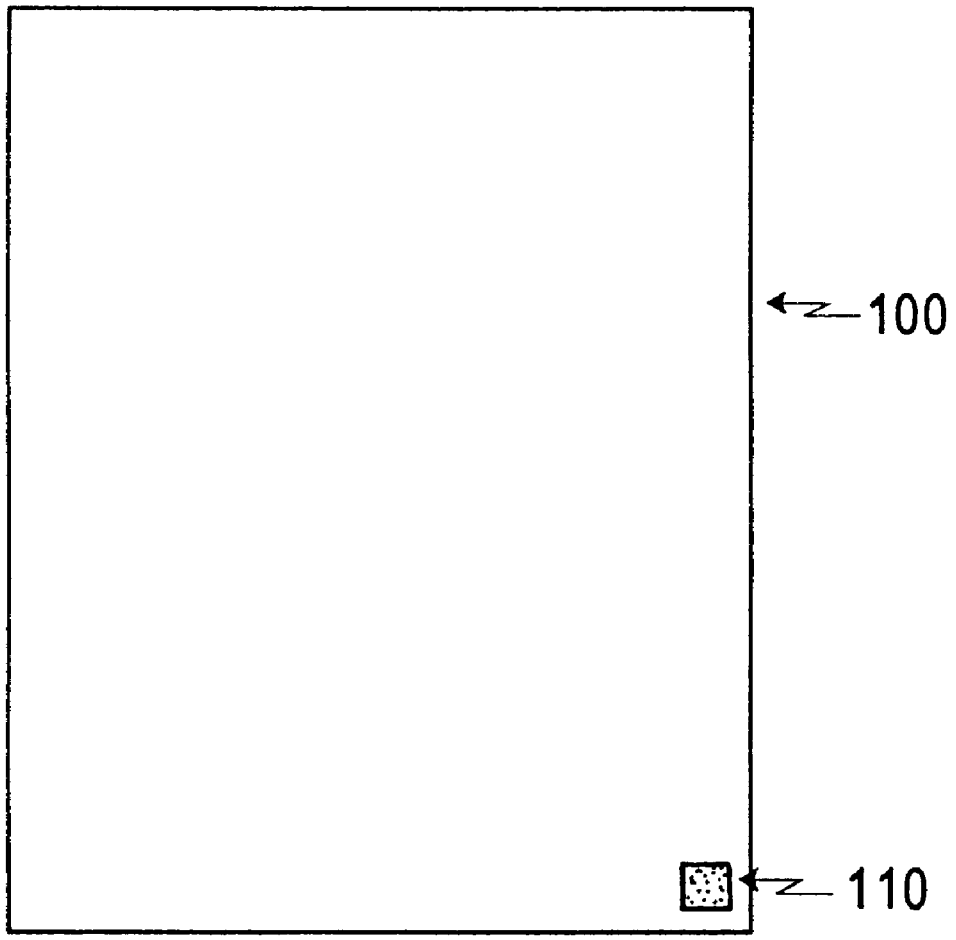
FIG. 1 is an illustration of a page printed with an ink density control block thereon.

FIG. 1 is an illustration of a page (100) printed with an ink density control block (110) thereon. The ink density control block 110 is included as part of the printing of a normal print job or it is printed on a separate sheet. Although it is illustrated as a page in FIG. 1, it is clear that the print medium could be a receipt, a label or any other printable material in addition to paper. What is important is to ensure that there is adequate contrast between the ink density control block 110 and the surrounding medium. The term ink, as used in this description, is a general term encompassing all types of material applied to a print medium. An ink supply is typically delivered in a cartridge to facilitate changing of the supply and, unless the context requires otherwise, the terms are synonymous.

Figure 2A:
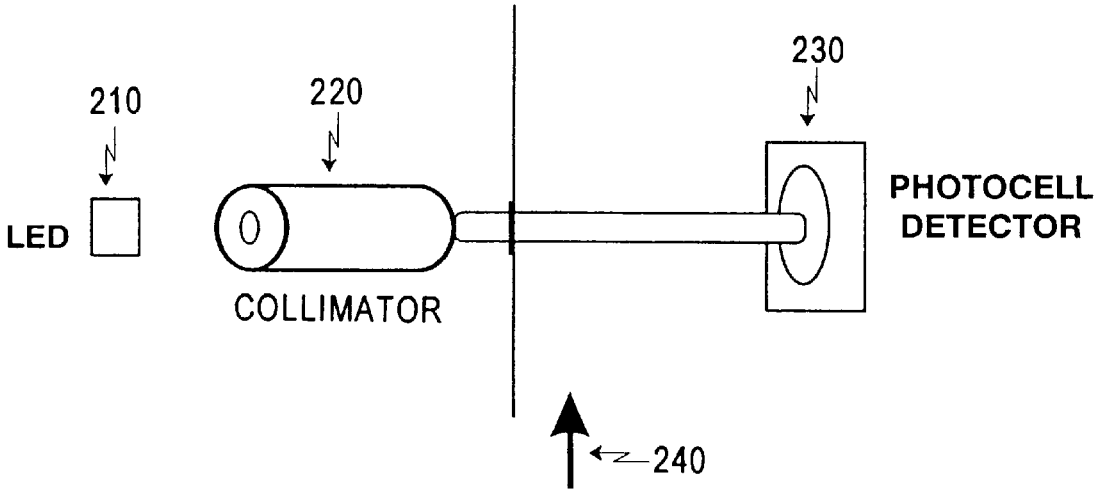
FIGS. 2A and 2B illustrate ink density detection apparatus using transmission and reflection, respectively.

FIG. 2A illustrates apparatus for detecting the intensity of the ink in the ink density control block printed on the medium 100 shown in FIG. 1. As a print job progresses, the print medium, such as paper, progresses in the direction shown in arrow 240 passing between light source, for example, LED 210 and photocell detector 230. The amount of light transmitted from the LED to the photocell is dependent upon the opacity of the medium interjected between the LED and the photocell. When unprinted medium is passing, there between, a reference level is detected, but when the print ink density control block passes between the LED and the photocell detector, the intensity of the light transmitted through the medium is considerably reduced. If it is reduced by an inadequate amount, then the amount of contrast is less than desirable and the ink supply should be changed. A collimator 220 may optionally be positioned between the LED 210 and the photodetector of the photocell 230. This reduces the amount of stray light in the environment which might effect the readings of ink density.

Figure 2B:
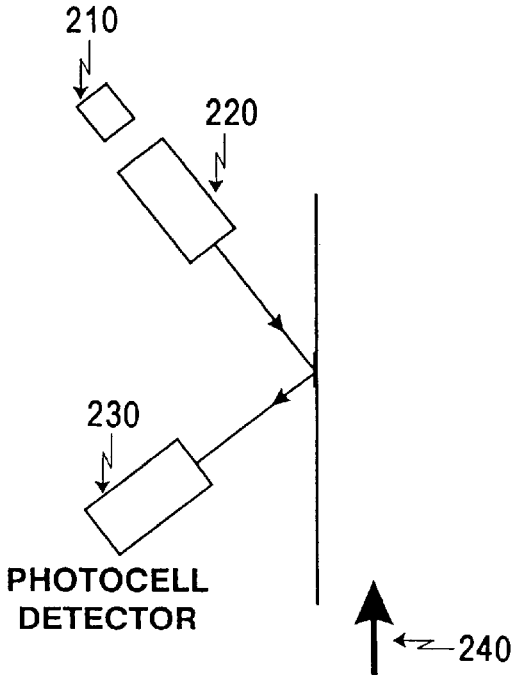

FIG. 2B shows a similar source 210 and detector 230. However, the apparatus is arranged to detect light reflected from the surface of the print medium as it progresses in the direction of arrow 240. When the print medium does not have any ink thereon, reflection will be a maximum. As the ink density control block passes between the LED and the photocell, an adequately dark ink control block will reduce the amount of light reflected into the photocell substantially. If only a minimal reduction in intensity is detected, then the ink density control block 110 is too light. Thus, the ink supply may require changing.

Figure 3:
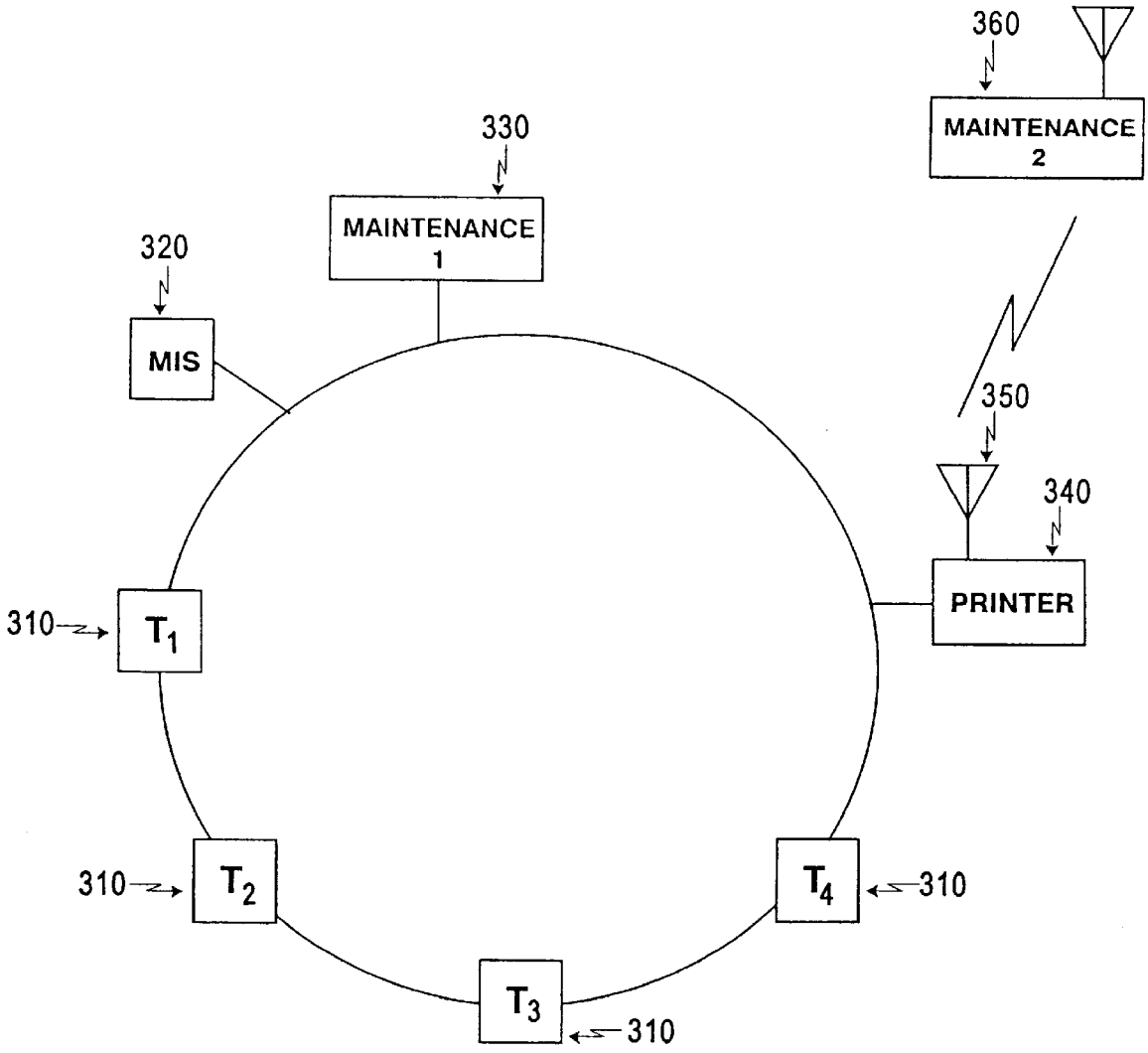
FIG. 3 illustrates a networked printer with maintenance reporting capabilities.

FIG. 3 illustrates a networked printer with maintenance reporting capability. A number of terminals T1–T4 (310) are connected to the network and each are capable of submitting print jobs. A management information system (320) may also be connected to the network. A maintenance facility 330 may also be on the network. As shown, when a low contrast print ink control block is detected, this condition is reported to the management information system 320 which records the fact that an ink cartridge replacement is eminent and orders the appropriate supplies for delivery to printer location 340 for delivery during the next service call. In addition, a message can be sent from printer 340 to maintenance facility 1 330 to schedule a visit by maintenance personnel. Alternatively, the printer 340 may be linked via an RF link 350 to maintenance facility 2 (360) at a different location. This could occur using automatic dialing over a cellular telephone link or over a regular RF link. A recorded message is played for the call recipient indicating that the ink supply needs replacement.

Figure 4:
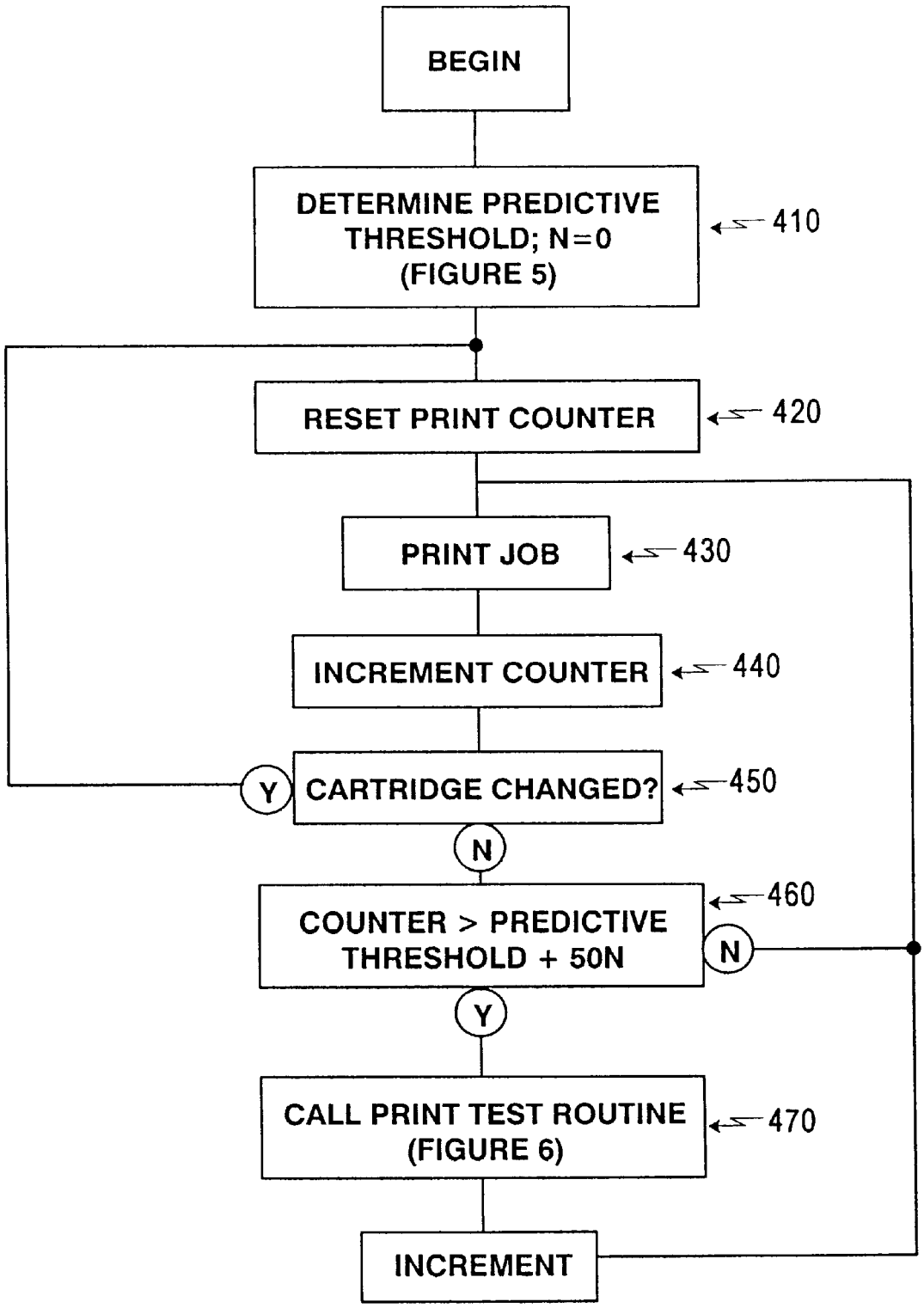
FIG. 4 is a flow chart of a process for initiating ink density testing.

FIG. 4 is a flow chart of a process for initiating ink density testing. For a particular type of printer, a predictive threshold is established (410) and used to determine when an ink cartridge is changed (450). When an ink cartridge should be changed (450) a print counter is reset (420) and then with each print job (430) the counter is incremented (440). When the print counter exceeds the predictive threshold, the print test routine is called (470). The predictive threshold is determined from either manufacturer's specifications or from experience. If it is known that a particular print cartridge will normally print 4,000 pages before needing replacement, then one might wish to begin periodic testing of the print quality beginning with copy number 3500 for that cartridge. The number N utilized in FIG. 4 represents the number of times, once the predictive threshold has been exceeded, that print tests have been conducted. In block 460, the number 50 refers to the frequency of testing ink density. In the example shown in FIG. 4, once the print counter exceeds the predictive threshold, a test of print quality will occur every 50 copies. If the number 50 were 100, then the test for print quality would occur every 100 copies.

Figure 5:
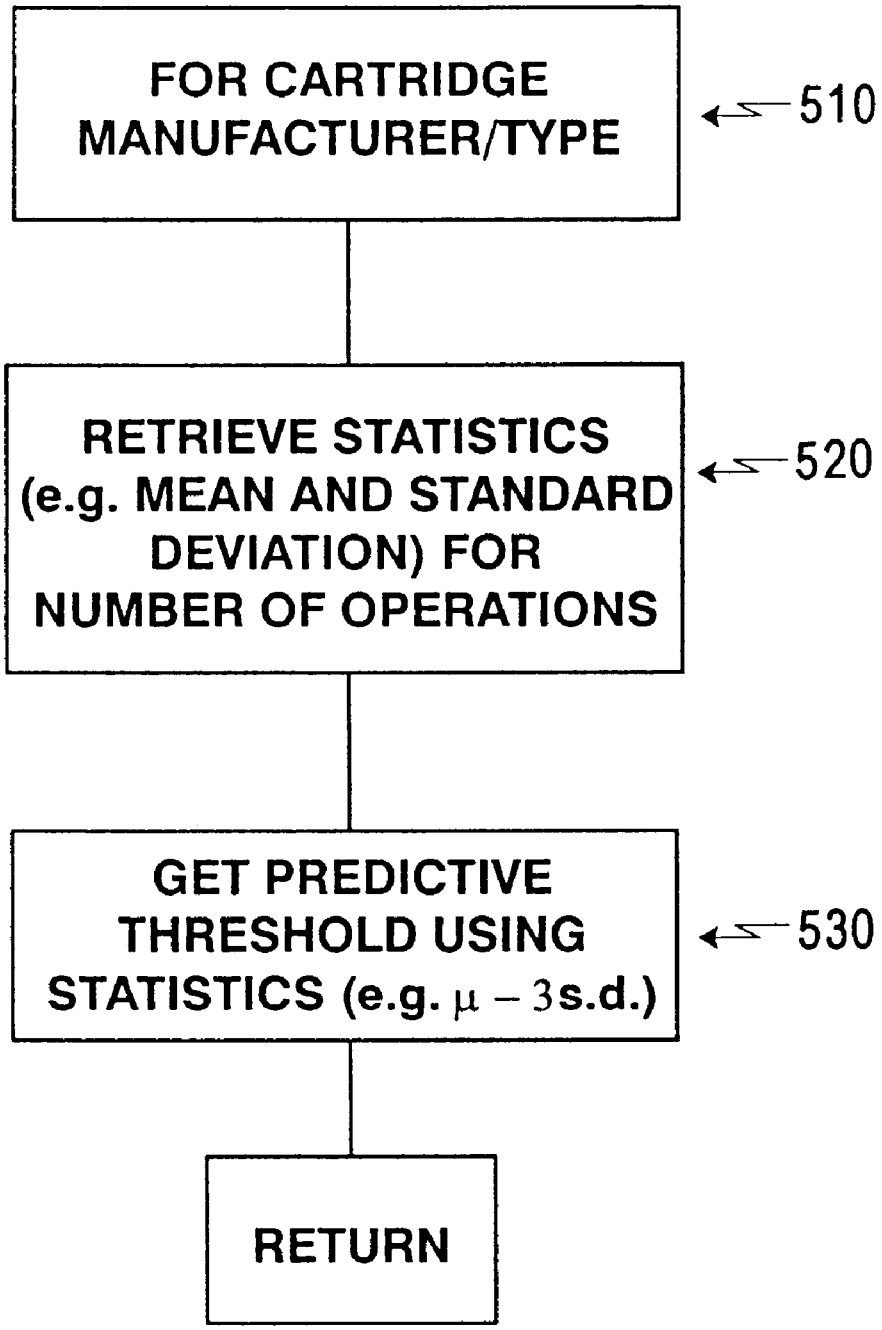
FIG. 5 is a flow chart of a process for predicting when ink testing should begin.

FIG. 5 is a flow chart of a process for predicting when ink testing should begin. In other words, for determining the print threshold as set forth in block 410 of FIG. 4. For the particular cartridge manufacturer and type of ink supply or cartridge (510), historical statistics (including the mean and standard deviation) or the number of print operations supported by the cartridge are retrieved from memory (520). The predictive threshold is set to ensure that print quality testing will occur, to a high level of confidence, before the cartridge can be expected to begin to run out of ink. In the example shown in item 530, the predictive threshold is set three standard deviations down from the mean. That would ensure to approximately a 98% confidence level that testing would begin before the ink quality began to degrade.

Figure 6:
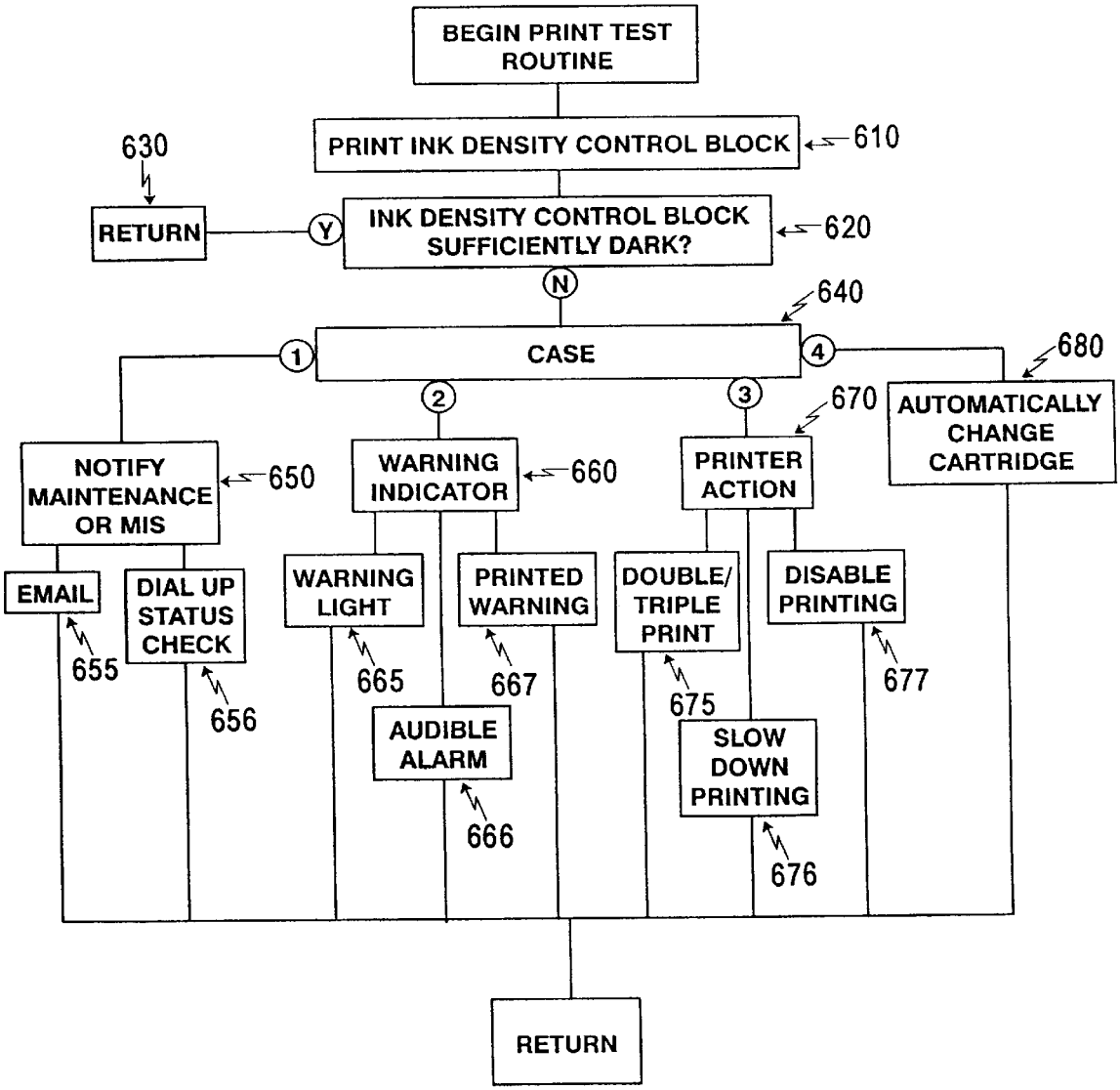
FIG. 6 is a flow chart of a process for selectively warning of or correcting a low ink condition.

FIG. 6 is a flow chart of a process for selectively warning of or correcting a low ink condition. When the print test routine is called, an ink density control block (610) is printed. The darkness of the control block is tested and if it is sufficiently dark (620-Y) the process returns (630). If it is inadequately dark, then one or more of a number of actions symbolically represented by the case statement 640, are taken. In a first case, a maintenance division of the company maintaining the printer or a management information system process is notified that the cartridge needs to be changed (650). This can be done either by E-mail (655) or by a dial-up status check of the remote terminal (656). In a second case, a warning indicator is activated at the printer location. This can be a warning light (665), an audible alarm (666) or a printed notice (667).

In a third case, the action of the printer is affected to indicate the low ink condition (670). This includes double or triple printing each character which would result in a darker printed character, slowing down the printer (676) or outright disabling printing (677).

Figure 7A:
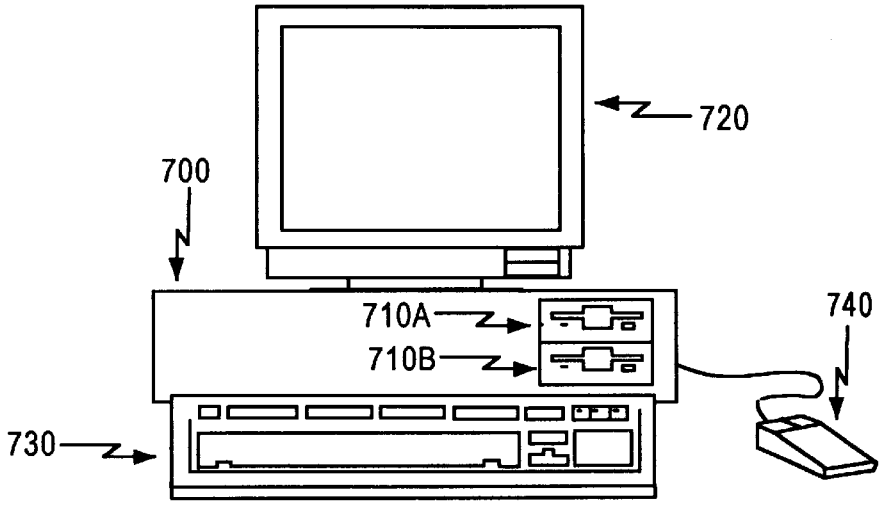
FIG. 7A illustrates a computer of a type suitable for monitoring ink density and controlling a printer.

In a fourth case, automatic equipment such as robotics could be utilized to replace the ink supply cartridge with a fresh one (680). FIG. 7A illustrates a computer of a type suitable for carrying out the invention. Viewed externally in FIG. 7A, a computer system has a central processing unit 700 having disk drives 710A and 710B. Disk drive indications 710A and 710B are merely symbolic of a number of disk drives which might be accommodated by the computer system. Typically, these would include a floppy disk drive such as 710A, a hard disk drive (not shown externally) and a CD ROM drive indicated by slot 710B. The number and type of drives varies, typically, with different computer configurations. The computer has the display 720 upon which information is displayed. A keyboard 730 and a mouse 740 are typically also available as input devices over interface 745. Preferably, the computer illustrated in FIG. 7A is a SPARC workstation from Sun Microsystems, Inc.

Figure 7B:
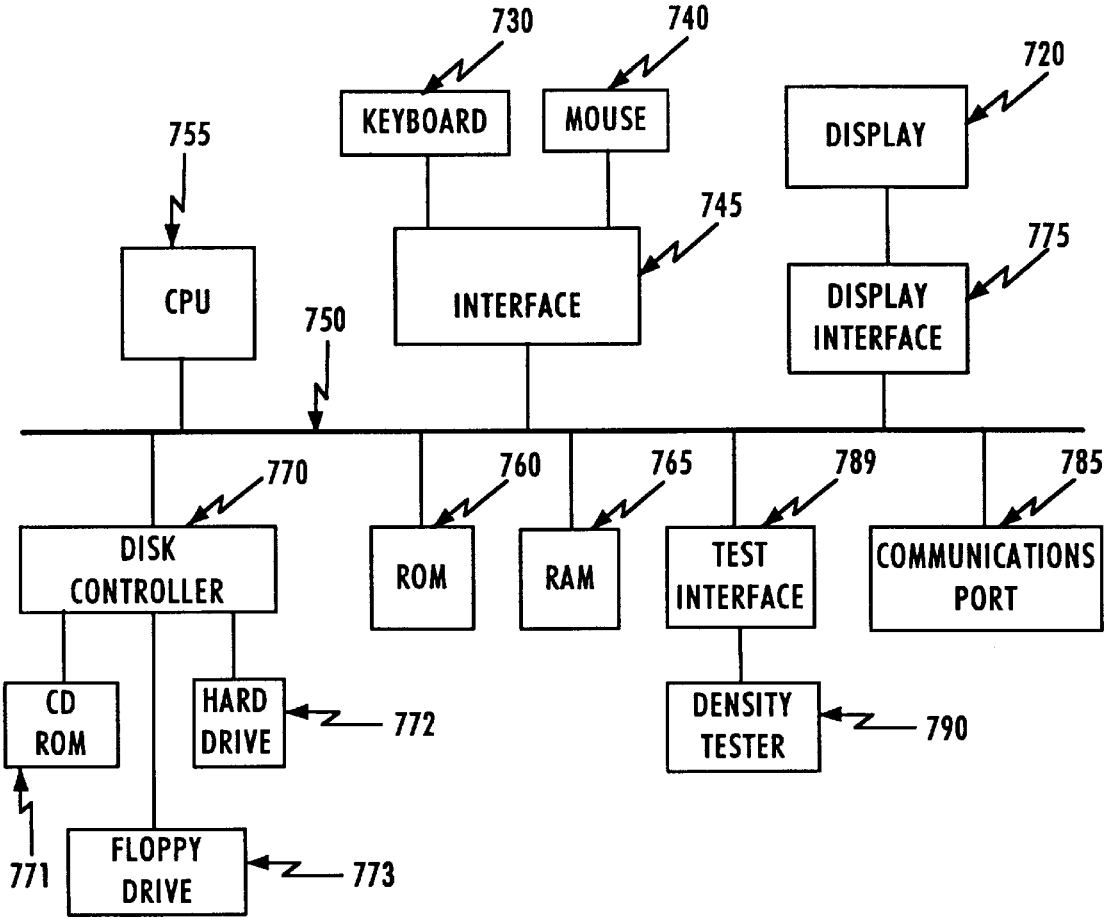
FIG. 7B illustrates a block diagram of the computer of FIG. 7A.

FIG. 7B illustrates a block diagram of the internal hardware of the computer of FIG. 7A. A bus 750 serves as the main information highway interconnecting the other components of the computer. CPU 755 is the central processing unit of the system, performing calculations and logic operations required to execute a program. Read only memory (760) and random access memory (765) constitute the main memory of the computer. Disk controller 770 interfaces one or more disk drives to the system bus 750. These disk drives may be floppy disk drives, such as 773, internal or external hard drives, such as 772, or CD ROM or DVD (Digital Video Disks) drives such as 771. A display interface 775 interfaces display 720 and permits information from the bus to be displayed on the display. Communications with external devices can occur over communications port 785.

A density tester (790) such as that shown in FIGS. 2A and 2B is connected to the CPU over test interface 789 and is controlled by the CPU.

Figure 7C:
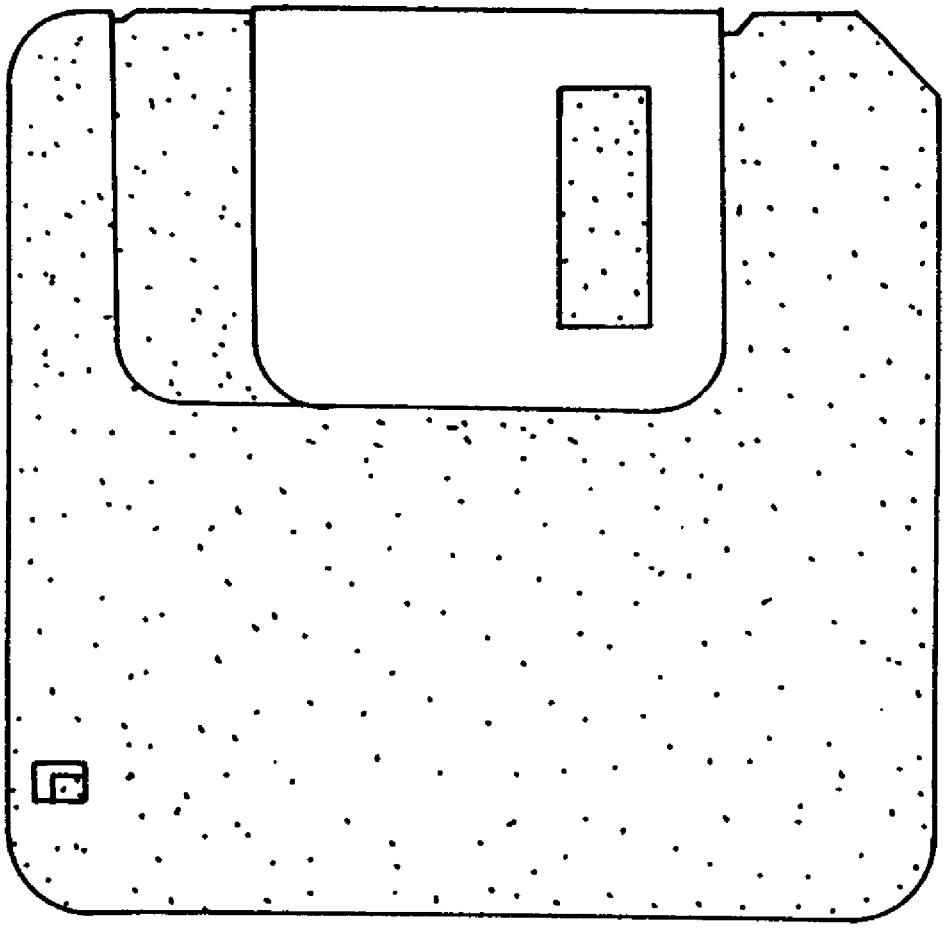
FIG. 7C illustrates a floppy disk containing a program usable with the computer of FIG. 7A.

FIG. 7C illustrates an exemplary memory medium which can be used with drives such as 773 in FIG. 7B or 710A in FIG. 7A. Typically, memory media such as a floppy disk, or a CD ROM, or a Digital Video Disk will contain, inter alia, program information for controlling the computer to enable the computer to perform its functions in accordance with the invention.

There has thus been disclosed techniques for ensuring that the output of a printer will be adequately legible at all times, thus overcoming the problems of the prior art.

In this disclosure, there is shown and described only the preferred embodiment of the invention, but, as aforementioned, it is to be understood that the invention is capable of use in various other combinations and environments and is capable of changes or modifications within the scope of the inventive concept as expressed herein.

I claim:

1. Printing apparatus comprising:

a. a computer processor having a communications port;

b. a printer connected to said computer processor;

c. a network; and d. an ink density detector connected to said computer processor and activated thereby to sample density of ink deposited on a print medium during a printing operation, said computer processor configured to report abnormal ink density to a management information system which records the fact that an ink supply is low and orders the appropriate supplies.

2. Apparatus of claim 1 in which the ink density detector comprises a light source and a photodetector.

3. Apparatus of claim 2 in which the ink density detector further comprises a columnator.

4. Apparatus of claim 1 in which the printing apparatus further comprises one of a transmitter or a modem for notifying at least one of remotely located personnel or a remotely locate process when ink density is unsatisfactory.

5. Apparatus of claim 1 in which the printing apparatus further comprises a control element configured to cause at least double printing of each character when ink density is unsatisfactory.

6. Apparatus of claim 1 in which the printing apparatus further comprises a control element configured to activate a warning indicator when ink density is unsatisfactory.

7. Apparatus of claim 1 in which the printing apparatus further comprises a control element configured to automatically change an ink supply.

8. A method of monitoring the quality of the product produced during printing comprising the steps of:

a. sampling density of ink deposited on a print medium during a printing operation only after a number of print operations equals or exceeds a predictive threshold;

b. recording the fact that an ink supply is low and orders the appropriate supplies.

9. The apparatus of claim 1 in which sampling density of ink begins when a number of print operations equals or exceeds a predictive threshold.

10. The method of claim 8 further comprising the step of:

b. providing an element for performing the step of, when the density of ink is unsatisfactory, performing one or more of:

b.1. Notifying at least one of maintenance personnel or a management information system process;

b.2. Activating a warning indicator;

b.3. Changing printer action; and b.4. Changing ink supplies.

11. A method for monitoring the quality of the product produced during printing comprising the steps of:

a. determining a predictive threshold of print operations expected to be obtained from an ink supply;

b. incrementing a counter for each print operation;

c. sampling the density of ink deposited on a print medium during a printing operation, beginning when the count of said counter equals or exceeds said predictive threshold; and d. recording the fact that an ink supply is low and ordering the appropriate supplies.

12. A method of servicing printers, comprising the steps of:

a. measuring ink density;

b. automatically reporting low ink density to a maintenance information system which records that fact that an ink supply is low;

c. ordering the appropriate supplies; and d. scheduling a service call when low ink density is reported.

13. A system for maintaining the quality of printing operations comprising:

a. a network;

b. one or more computer connected to said network; and c. a printer connected to said network which samples ink density deposited on a print medium during a printing operation, in which the printer is configured to notify maintenance personnel or a management information system process over the network when the density of ink is unsatisfactory.

14. A system for maintaining the quality of printing operations comprising:

a. a network;

b. one or more computers connected to said network; and c. a printer connected to said network which samples ink density deposited on a print medium during a printing operation, in which the printer is configured to receive a remote query over a cellular telephone link when the density of ink is unsatisfactory.

15. A system for maintaining the quality of printing operations comprising:

a. a network;

b. one or more computers connected to said network; and c. a printer connected to said network which samples ink density deposited on a print medium during a printing operation, in which the printer is configured to receive a remote query over the network and report when the density of ink is unsatisfactory.

16. A computer program product, comprising;

a. a memory medium; and b. a computer program stored on said medium, said computer program containing instructions to b.1. cause a printer to sample density of ink produced by said printer during printing operations and to report abnormal density to a remote location over a communications link.

17. Apparatus of claim 1 in which said printer sends a message to a maintenance facility for the purpose of scheduling a visit by maintenance personnel.

18. The method of claim 8, further comprising the step of reporting the deficient ink density to a maintenance facility, via a network RF link, for the purpose of scheduling a visit by maintenance personnel.

19. The method of claim 11, further comprising the step of reporting the deficient ink density to a maintenance facility, via a network RF link, for the purpose of scheduling a visit by maintenance personnel.

20. The method of claim 12, further comprising the step of automatically reporting the low ink density to a maintenance facility, via a network RF link, for the purpose of scheduling a visit by maintenance personnel.

* * * * *